United States Patent [19]

Ushijima

[11] 4,134,756

[45] Jan. 16, 1979

[54] PERMANENT MAGNET ALLOYS

[75] Inventor: Makoto Ushijima, Kumagaya, Japan

[73] Assignee: Hitachi Metals, Ltd., Japan

[21] Appl. No.: 830,499

[22] Filed: Sep. 6, 1977

[30] Foreign Application Priority Data

Sep. 7, 1976 [JP] Japan ..... 51-106317

[51] Int. Cl.[2] ..... C22C 30/02

[52] U.S. Cl. ..... 75/122; 75/134 C; 75/134 F; 148/31.57

[58] Field of Search ..... 75/124, 122, 134 C, 75/134 F; 148/31.57, 101

[56] References Cited

U.S. PATENT DOCUMENTS

| | | | |
|---|---|---|---|
| 3,314,828 | 4/1967 | Harrison | 148/101 |
| 3,432,369 | 3/1969 | Naastepad | 148/31.57 |
| 3,528,805 | 9/1970 | Harrison | 148/31.57 |

FOREIGN PATENT DOCUMENTS

| | | | |
|---|---|---|---|
| 419284 | 11/1963 | Japan. | |
| 4737333 | 10/1966 | Japan | 148/31.57 |
| 987636 | 3/1965 | United Kingdom | 148/31.57 |

*Primary Examiner*—Arthur J. Steiner
*Attorney, Agent, or Firm*—Craig & Antonelli

[57] ABSTRACT

Improved precipitation hardening permanent magnetic alloys of Alnico 9 type having comparatively lower Co content of 28 - 30 weight percent and further contain 0.02 - 0.2% C, 0.1 - 1% S and 0.1 - 4.0% Nb together all by weight, and Nb to Ti ratio of the alloys satisfies the formula;

$$52.5 \leqq 7\,Nb + 10\,Ti \leqq 63 \text{ (by weight \%)}.$$

Due to the above-mentioned composition range of the alloying elements and the controlled relation between the content of the Nb and Ti as indicated above, the alloys are allowed to solidify into columnar grains by ordinary moulding and to display excellent magnetic properties.

5 Claims, 2 Drawing Figures

PERMANENT MAGNET ALLOYS

BACKGROUND OF THE INVENTION

This invention relates to permanent magnet alloys and more particularly to Alnico 9 type permanent magnets in which Co content is smaller than that of the conventional Alnico tupe permanent magnet alloys and which further contain three elements, C, S and Nb, together.

Generally so-called Alnico type permanent magnet alloys contain not only such constituting elements as Al, Ni, Co, Cu, and Fe but also many additives to improve magnetic properties. Further, the improvement of magnetic properties has not been made depending on the composition alone but has been made based on many other factors such as directional property of crystal structure, isothermal magnetic treatment, aging, etc.

These factors contribute, of course, to the improvement of residual flux density (Br), coercive force (Hc), and maximum energy product ((BH) max) but a particularly important purpose of the consideration of these factors is to improve the maximum energy product ((BH) max).

Among Alnico type magnets now available, the one that has the greatest maximum energy product ((BH) max) is Alnico 9 type permanent magnets having a maximum energy product ((BH) max) of 9.0 MGOe or more, which is produced by subjecting a high Ti content Alnico 9 type magnet to a unidirectional solidification to achieve columnar crystalization, subjecting it to solution treatment at a high temperature of 1200° C or more, cooling it rapidly at the cooling rate of 3° C/sec. after the solution treatment, keeping it in a magnetic field at a constant temperature below Curie point for five to ten minutes, and then subjecting it to aging.

This Alnico 9 type permanent magnet, typical composition of which is either Al 7.2%, Ni 14.0%, Co 34.0% Cu 4.0%, Ti 5.0% the remainder being Fe, or Al 7.2%, Ni 13.0%, Co 38.0%, Cu 3.0%, Ti 8.0% the remainder being Fe, all of the above-mentioned percentages being percentages by weight, has a columnar crystal structure after having bean subjected to a unidirectional solidification and has a high maximum energy product ((BH) max), more than twice as much as that of Alnico 5 type permanent magnets used in speakers and motors in general, due to a special heat-treatment. This, however, is not yet produced in an industrial mass production scale.

There are two reasons for it. Firstly, the Alnico 9 type permanent magnet is expensive because it requires much amount of Co and therefore its uses are inevitably limited. In order to obtain the magnetic properties of a residual flux density (Br) of 10000 G (Gauss) or more, a coercive force (Hc) of 1350 Oe (Oersted) or more and a maximum energy product ((BH) max) of 9.0 MGOe (M Gauss Oersted) or more, a Co content of more than 34% is indispensable. Studies have been made to lower the Co content below 34% but the decrease of Co content in Alnico 9 type permanent magnets had a very sharp influence on the magnetic properties and drastically lowered the residual flux density (Br), coercive force (Hc) and maximum energy product ((BH) max). Thus it was extremely difficult to obtain the magnetic properties in a magnet which can be produced on a mass production scale.

Secondly, as it contains a high percentage of Ti, it generally has a finely grained structure which is hard to be made into a good columnar structure by subjecting it to a unidirectional solidification even by such a process as zone melting, hot moulding or exothermic moulding. While the addition of such element or elements as S, C, P, Se, Te, etc. is effective in forming a columnar structure, a single addition of one of these elements can not effect sufficient crystal alignment. A multiple addition of elements such as C plus S effects crystal alignment but does not produce the desired magnetic properties in an Alnico 9 type permanent magnet containing less than 34% by weight of Co.

The present invention has been made in view of the above-mentioned problems involved in Alnico type permanent magnets, particularly, Alnico 9 type permanent magnets and has an object of providing improved Alnico 9 type permanent magnets having a low Co content of 28 - 30% and yet having magnetic properties equal to or superior to those obtained by the conventional Alnico 9 type alloys.

SUMMARY OF THE INVENTION

The alloys of the present invention are characterized in that they consists essentially of 7 to 12% Al, 10 to 20% Ni, 28 to 30% Co, 1 to 7% Cu, 3.0 to 6.0% Ti as their major constituting elements with the remainder being Fe and are precipitation hardenable permanent alloys in which 0.02 to 0.2% C, 0.1 to 1.0% S, 0.1 to 4.0% Nb are contained and in which Nb and Ti values (Nb to Ti ratio) satisfy the following formula:

$$\text{Nb (\% by weight)} = 10/7\ \text{Ti (\% by weight)} + (7.5 \text{ to } 9)$$

The alloys of the present invention may also contain less than 2% Si, less than 1% Zr, less than 3% Ta, less than 3% Cr, less than 1% Mn, less than 1% Sn, less than 0.5% B and less than 2% in total of one or more of the elements selected from a group consisting of V, Mo, W, Br, and Pb.

BRIEF DESCRIPTION OF THE DRAWINGS

The present invention will become fully understood from the detailed description hereinbelow and the accompanying drawings, which are given by way of illustration only, and thus are not limitative of the present invention wherein.

DETAILED DESCRIPTION OF THE INVENTION

Figure 1:
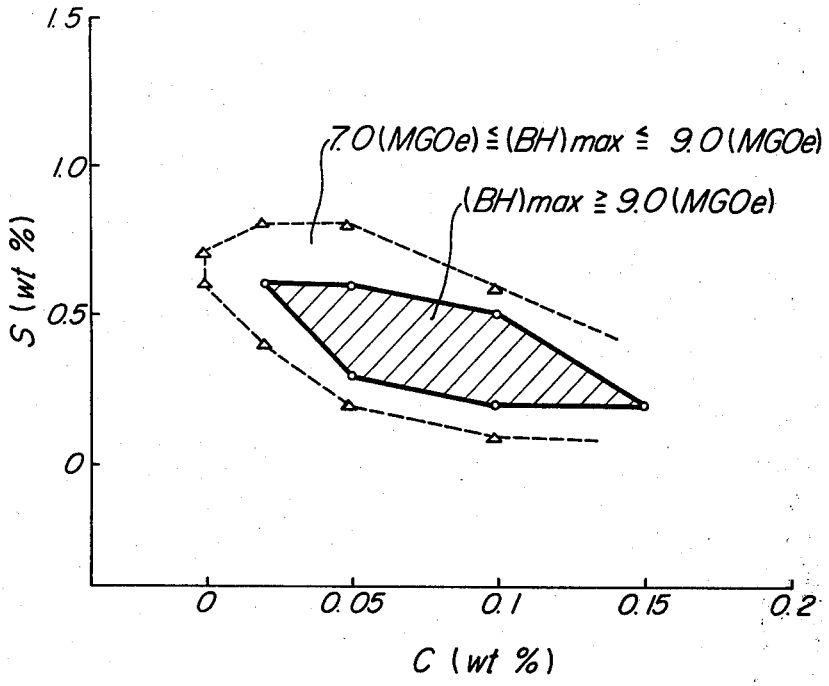
FIG. 1 is a graph showing the relationship between C and S contents and the magnetic properties after columnar crystalization.

According to the present invention, the columnar crystalization can be easily obtained by the addition of three elements, i.e., C, S and Nb together, in the amounts specified, in spite of the fact that Co content is reduced to 28 to 30%, the values notably smaller when compared with that of the conventional Alnico 9 type permanent magnets. Moreover, Alnico 9 type permanent magnets having magnetic properties superior to those of the conventional Alnico 9 type permanent magnets can be obtained by maintaining Ti and Nb contents at the values that satisfy the above-mentioned specific formula.

Now the composition ranges of the permanent magnet alloys of this invention will be explained. The alloys contain 7 to 12% of Al. If the Al content is less than 7%, the solution treatment temperature will become very high and a rapid cooling is required after the solution treatment to obtain the desired magnetic properties. On the other hand, when the Al content exceeds 12%, the magnets become brittle.

Acceptable range for Ni content is 10 to 20%. With the Ni content of less than 10%, the residual flux density (Br) becomes too low to be used for practical use. In the range of 14 to 15% of Ni, the alloys show the highest coercive force (Hc) and maximum energy product ((BH) max). When the Ni content is more than 20%, the coercive force (Hc) becomes considerably lower.

The Co content must be in the range of 28 to 30%. The conventional Alnico type permanent magnets should contain 34 to 40% Co to obtain a maximum energy product ((BH) max) of 9.0 M Gauss Oersteds or more but the alloys of this invention contain less than 34%, i.e., 28 to 30% Co. With less than 28% Co, even the change of the relative composition ratios of Nb, C, S, Ti etc. can not make up the decrease in the magnetic properties due to the decrease of the Co content. For instance, Table 1 shows the compositions and magnetic properties of the magnets with isotropic crystal grains containing more than 4.0% Ti and more than 28% Co. As claer from Table 1, the alloys containing less than 34% Co show a considerable degradation in the residual flux density (Br) and maximum energy product ((BH) max).

Table 1

| Al | Ni | Co | Cu | Ti | Fe | Br (G) | Hc (Oe) | (BH) max (MGOe) |
|---|---|---|---|---|---|---|---|---|
| 8 | 17 | 28 | 3 | 4 | Remainder | 7500 | 980 | 4.5 |
| 7 | 15 | 32 | 5 | 8 | " | 8800 | 1050 | 4.2 |
| 7 | 15 | 35 | 4 | 5 | " | 8200 | 1600 | 5.3 |
| 7 | 14 | 36 | 3 | 6 | " | 8000 | 1650 | 5.5 |
| 7 | 14 | 39 | 3 | 7 | " | 7400 | 1900 | 6.0 |

This trend does not change even if the Ti content is changed to the value, in accordance with the Co-Ti relation, corresponding to the Co content. Also the addition of C, S, Se, Te, Pb, etc., the additives effective for forming columnar grains, solely or in combination in the optimum amounts did not produce anything but a magnetic property far short of the maximum energy product ((BH) max) of 9.0 M Gauss Oersteds or more. It was for such reason that the maximum energy product ((BH) max) of 9.0 MGOe or more had not been achieved by Alnico 9 type permanent magnet containing less than 34% Co. Therefore, in order to lower the Co content from the conventional mount of 34% or more to 28 30% and yet to obtain the excellent magnetic properties, it was necessary to solve the disadvantage arising from the decrease of Co content. According to the present invention, this problem was solved by optimizing Ti content and by adding C, S, and Nb together. Ti is effective for improving the coercive force (Hc) of the permanent magnets but should preferably be limited within the range of 3.0 to 6.0% as it will bring about a grain refinement and lower the residual flux density. It has been found that when the Ti content is kept within the range of 3.0 to 6.0%, the combined addition of three elements, C, S, and Nb has the effect of improving the residual flux density (Br), coercive force (Hc), maximum energy product ((BH) max) and rectangular hysteresis loop characteristic in spite of the lowering of the Co content to 28 to 30%. By specifying the Ti content thus within 3.0 to 6.0% and by specifying, as will be explained hereinafter, the C, S, and Nb contents and the correlation between the Ti and Nb contents a permanent magnet having excellent magnetic properties can be obtained with a low Co content of 28 to 30%.

Table 2 shows by way of example the magnetic properties obtained after a columnar crystalizatization treatment of a permanent magnet consisting mainly of 7.2 to 7.5% Al, 14.0 to 14.3% Ni, 28 to 30% Co and 3.5 to 4.0% Cu and 5.0 to 5.2% Ti, with the remainder being substantially Fe, to which C, S and Nb were added.

Table 2

| | C (%) | S (%) | Nb (%) | Br | Hc | (BH) max |
|---|---|---|---|---|---|---|
| | — | 0.3 | — | 8,600 | 1150 | 4.8 |
| 2 | — | 0.3 | 1.5 | 8,700 | 1300 | 6.3 |
| 3 | 0.1 | — | 1.0 | 8,300 | 1200 | 4.5 |
| 4 | 0.1 | 0.3 | — | 9,000 | 1280 | 7.3 |
| 5 | 0.1 | 0.3 | 1.0 | 10,000 | 1450 | 9.3 |
| 6 | 0.1 | 0.3 | 1.5 | 10,200 | 1500 | 10.0 |
| 7 | 0.1 | 0.3 | 2.0 | 10,200 | 1550 | 9.5 |
| 8 | 0.1 | 0.3 | 3.0 | 10,000 | 1450 | 9.2 |
| 9 | — | — | 1.5 | 8,700 | 1350 | 5.6 |

As can be seen in the table 2 above, the maximum energy products ((BH) max) of the alloys containing 28 to 30% Co is 4.8 when only S is added, 5.6 when only Nb is added, 6.3 when S and Nb are added, 4.5 when C and Nb are added, and 7.3 when C and S are added. However, when the alloys contain all the three elements C, S and Nb together, they show the maximum energy products ((BH) max) in the range of 9.2 to 10.0 M Gauss Oersteds and greatly improved magnetic properties.

In FIG. 1, the C and S contents were varied for the samples, while keeping Al 7%, Ni 14.5%, Co 29.8%, Cu 3.5%, Ti 5% and Nb 1.5%. It can be understood from the graph that the magnetic properties become particularly better when the C and S contents are within the specific range.

Figure 2:
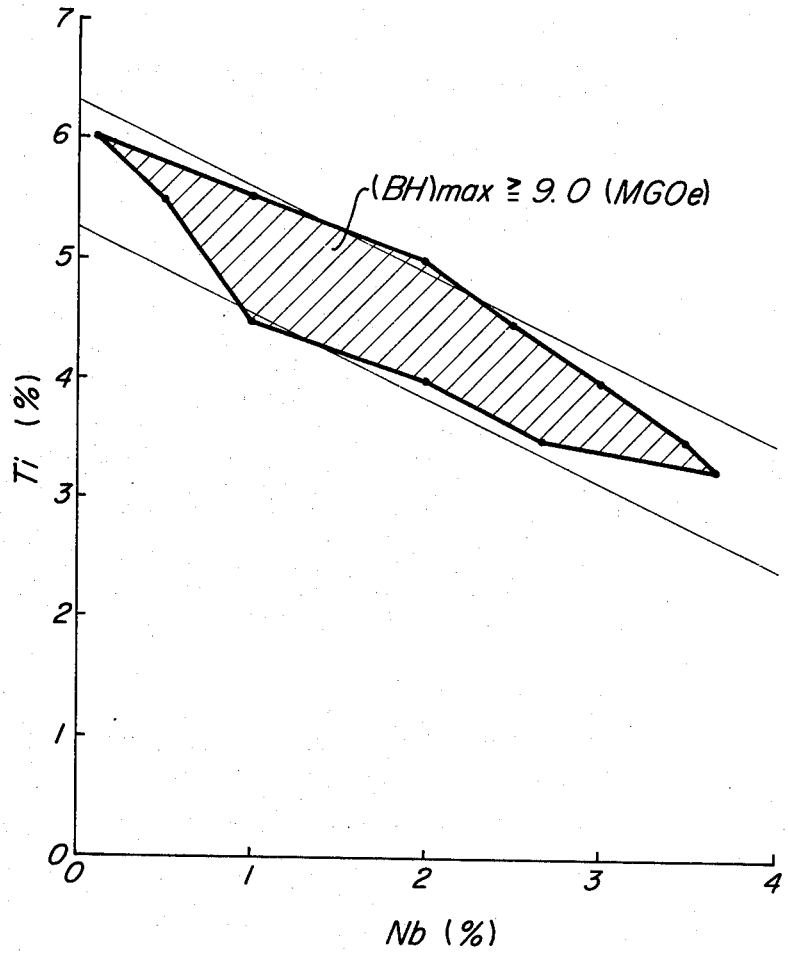
FIG. 2 is a graph showing the region for Nb and Ti contents within which ((BH) max) will become 9.0 MGOe or more.

FIG. 2 indicates the relationship between Ti and Nb. When the Ti content is not in the range of 3 to 6%, Nb exhibits no appreciable effect at all, and when the Ti is in the range of 3 to 6%, Nb must be within the range of 0.1 to 4.0% to produce the optimum magnetic properties. The samples used here contained 7% Al, 14.5% Ni, 29.8% Co, 3.5% Cu, 0.1% C, 0.3% S and varied content of Nb and Ti. From the graph, it can be noted that the Nb and Ti conents should fall within the range defined by the two lines represented by;

$$7\ \text{Nb (\% by weight)} + 10\ \text{Ti (\% by weight)} = 52.5$$

and $$7\ \text{Nb (\% by weight)} + 10\ \text{Ti (\% by weight)} = 63$$

From this, it can be also noted that as the Ti content decreases, the Nb content must be increased and as the Ti content increases, the Nb content must be decreased but not lower than 0.1% below which Nb does not show any desirable effect. Also Ti content should not exceed 6.0% for obtaining high magnetic properties. Further the desirable Nb and Ti contents are 0.5 to 3.0% and 4.0 to 5.5%, respectively.

The range of the Cu content of the alloys of this invention is 1 to 7%. When the Cu content is within the range of 1.0 – 4.0%, the alloys show the highest coercive force (Hc). When the Cu content exceeds 7%, the alloys lose their coercive force (Hc) considerably.

The alloys of this invention also contain 0.02 to 0.02% C, 0.1 to 1.0% S and 0.2% C. When the S content exceeds 1.0%, the coercive force is lowered. When the C and S contents are less than 0.02% and 0.1% respectively, no appreciable effect can be obtained. Incidentially, the C and S are the additives for forming columnar crystal grains; they become a cause for degradation in the coercive force (Hc) and the maximum energy product ((BH) max) in isotropic crystal grains but are effective for forming columnar grains. Therefore, if we are to consider the formation of columnar grains only, the greater the amounts of C and S to be added are, the better the columnar grain formation will be, but the magnetic properties to be obtained after such formation are not necessarily good. In this way, the addition of C and S results in two contradictory effects, an improvement of the magnetic properties by their promotion of the columnar grain formation and a degradation of the same properties. This problem, however, can be solved by setting the ranges of the C and S contents as mentioned above.

One of the characteristics of the permanent magnet alloys of this invention is that as they have a lower Co content, they have a narrower ($\alpha + \gamma$) two phase region which therefore need not be rapid-cooled; in other words, there does not accompany a risk of crack formation.

A British Patent Specificatiion No. 987,636 discloses a permanent magnet containing less than 30% Co, and describes the employment of a zone melting technique for forming columnar grains. The formation of columnar grains in this magnet alloy even by hot moulding method is extremely difficult even on an experimental scale. For the alloys of this invention, however, a hot moulding can be effectively employed for the purpose. This difference is attributable to the fact that while said British Patent uses a combination of Nb and S, the alloys of this invention contain three elements together, Nb, S and C in combination.

The formation of columnar grains by hot moulding accomplishes the manufacture of the magnets of any size and shape. Now how the permanent alloys in accordance with this invention were made will be explained hereafter.

The materials to make up the desired composition were melted in a conventional melting furnace and the molten alloy was poured into a mould heated to 1000° to 1100° C and placed on chill plates. During its solidification, a unidirectional cooling was given to it to form a columnar crystal structure. A sample of 30 mm in diameter and 80 mm in length thus produced was subjected to a solution treatment at 1250° C for 20 minutes and then cooled down to the room temperature. After this treatment, it was subjected to isothermal treatment at the optimum isothermal treating temperature, and then subjected to aging to produce a permanent magnet.

In Table 3, the compositions and the magnetic properties of the permanent magnet alloys of this invention are shown together with those of the other permanent magnet alloys for comparison.

Table 3

| Alloy No. | Al | Ni | Co | Cu | Ti | Nb | C | S | Fe | Br (G) | Hc (Oe) | (MGOe) (BH) max |
|---|---|---|---|---|---|---|---|---|---|---|---|---|
| 1 | 7.4 | 14.3 | 28.2 | 3.2 | 5.2 | 0.5 | 0.01 | 0.02 | Remainder | 8,600 | 1,390 | 4.4 |
| 2 | 7.3 | 14.8 | 29.3 | 3.1 | 5.1 | 1.5 | 0.01 | 0.01 | " | 8,500 | 1,460 | 4.8 |
| 3 | 7.9 | 14.6 | 29.4 | 2.9 | 4.4 | 2.0 | 0.01 | 0.02 | " | 7,900 | 1,500 | 4.5 |
| 4 | 7.6 | 14.3 | 29.7 | 3.2 | 5.1 | 1.7 | 0.02 | 0.3 | " | 9,600 | 1,470 | 7.4 |
| 5 | 7.1 | 14.7 | 29.2 | 3.0 | 5.3 | 1.4 | 0.01 | 0.7 | " | 9,650 | 1,450 | 7.8 |
| 6 | 7.9 | 14.8 | 29.8 | 3.1 | 5.0 | 1.5 | 0.11 | 0.02 | " | 8,800 | 1,430 | 4.6 |
| 7 | 7.4 | 14.4 | 29.4 | 3.0 | 5.3 | 1.6 | 0.17 | 0.03 | " | 8,750 | 1,460 | 4.8 |
| 8 | 7.8 | 14.8 | 29.6 | 3.0 | 5.2 | 1.6 | 0.21 | 0.03 | " | 8,650 | 1,420 | 4.8 |
| 9 | 7.5 | 14.5 | 29.5 | 3.1 | 5.3 | 1.4 | 0.05 | 0.3 | " | 10,100 | 1,480 | 9.3 |
| 10 | 7.6 | 14.7 | 29.8 | 2.9 | 5.0 | 1.5 | 0.06 | 0.6 | " | 10,150 | 1,480 | 9.4 |
| 11 | 7.8 | 14.6 | 28.9 | 3.0 | 5.1 | 1.6 | 0.11 | 0.3 | " | 10,200 | 1,500 | 9.8 |
| 12 | 7.3 | 14.8 | 29.9 | 3.3 | 5.2 | 1.5 | 0.10 | 1.1 | " | 9,600 | 1,350 | 7.2 |
| 13 | 7.7 | 14.3 | 29.8 | 3.0 | 5.1 | 1.5 | 0.16 | 0.3 | " | 10,100 | 1,450 | 9.4 |
| 14 | 7.6 | 14.5 | 29.6 | 3.0 | 5.2 | 1.5 | 0.18 | 0.2 | " | 9,900 | 1,440 | 9.2 |
| 15 | 7.6 | 14.5 | 29.6 | 3.0 | 5.2 | 1.5 | 0.25 | " | 9,300 | 1,370 | 7.3 | |

C ≦ 0.02 % is included as an impurity
S ≦ 0.03 % is included as an impurity.

In the Table 3, Alloys No. 9, 10, 11, 13, 14 are the alloys which fully satisfy the composition limits of the present invention.

As explained above, the permanent magnet alloys of this invention display excellent magnetic properties in spite of their low Co content as compared with that of the conventional Alnico 9 type permanent magnets, because of their chemical compositions as described above which include all the three elements C, S and Nb together in combination. Also because of their low Co content of 28 to 30%, the ($\alpha + \gamma$) phase region is narrow and does not require rapid cooling, thus enabling the manufacture of large size Alnico 9 type permanent magnets without entailing a crack. The present invention further has the advantage that the permanent magnets of any shape can be produced as a hot moulding method can be used effectively.

I claim:

1. A precipitation hardening type permanent magnet alloy having a columnar crystal structure and having a maximum energy product greater than or equal to 9.0 MGOe, which consists essentially of: 7 to 12% Al, 10 to 20% Ni, 28 to 30% Co, 1 to 7% Cu, 3.0 to 6.0% Ti, 0.02 to 0.2% C, 0.1 to 1.0% S and 0.1 to 4.0% Nb the balance being Fe; and the Nb to Ti ratio satisfies the following formula:

$$52.5 \leqq 7\,Nb + 10\,Ti \leqq 63.$$

2. A permanent magnet alloy as claimed in claim 1, wherein C is 0.05 to 0.16%, S is 0.3 to 1.0% and Nb is 1.4 to 1.6%.

3. A permanent magnet alloy as claimed in claim 1, wherein the Nb, C and S contents fall within the enclosed regions shown in FIG. 1 and FIG. 2.

4. A precipitation hardening type permanent magnet alloy having a columnar crystal structure and having a maximum energy product greater than or equal to 9.0 MGOe, which consists essentially of: 7 to 12% Al, 10 to 20% Ni, 28 to 30% Co, 1 to 7% Cu, 3.0 to 6.0% Ti, 0.02 to 0.2% C, 0.1 to 1.0% S, 0.1 to 4.0% Nb, less than 2%

Si, less than 1% Zr, less than 3% Ta, less than 3% Cr, less than 1% Mn, less than 1% Sn, less than 0.5% B and less than 2% in total of one or more of the elements selected from the group consisting of V, Mo, W, Br, and Pb, the balance being Fe; and the Nb to Ti ratio satisfying the following formula:

$$52.5 \leqq 7\,Nb + 10\,Ti \leqq 63.$$

5. A permanent magnet alloy as claimed in claim 4, wherein C is 0.05 to 0.16%, S is 0.3 to 1.0% and Nb is 1.4 to 1.6%.

* * * * *